US007261591B2

(12) United States Patent
Korsunsky et al.

(10) Patent No.: US 7,261,591 B2
(45) Date of Patent: Aug. 28, 2007

(54) PLUGGABLE CONNECTOR WITH A HIGH DENSITY STRUCTURE

(75) Inventors: Iosif R. Korsunsky, Harrisburg, PA (US); Chong Yi, Mechanicsburg, PA (US); Robert Brown, Hurrisburg, PA (US); Robin Johnson, Dover, PA (US); Richard (Rick) Emenheiser, Mount Joy, PA (US); Richard (Dick) Malehorn, II, York, PA (US); Charles (Chuck) Blichasz, Boiling Springs, PA (US); Joanne Shipe, Harrisburg, PA (US); Tod Harlan, Mechanicsburg, PA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/040,531

(22) Filed: Jan. 21, 2005

(65) Prior Publication Data

US 2006/0166551 A1 Jul. 27, 2006

(51) Int. Cl.
*H01R 13/60* (2006.01)

(52) U.S. Cl. ..... 439/541; 439/607

(58) Field of Classification Search ..... 439/541, 439/541.5, 607–610, 79, 76.1, 676, 488–489, 439/540.1

See application file for complete search history.

(56) References Cited

U.S. PATENT DOCUMENTS 6,264,501 B1 * 7/2001 Hung et al. ..... 439/541.5
6,402,563 B1 * 6/2002 Shi et al. ..... 439/676
6,558,191 B2 5/2003 Bright et al.
6,682,365 B1 * 1/2004 Walker et al. ..... 439/488
6,688,913 B2 * 2/2004 Li ..... 439/541.5
6,793,526 B1 * 9/2004 Hsu et al. ..... 439/541.5
6,976,870 B1 * 12/2005 Li ..... 439/541.5

* cited by examiner

*Primary Examiner*—Truc T. Nguyen
*Assistant Examiner*—Edwin A. Leon
(74) *Attorney, Agent, or Firm*—Wei Te Chung

(57) ABSTRACT

A pluggable connector (100) includes a dielectric housing (1), a contact group (2), a first sub-assembly (3), a second sub-assembly (4), a third sub-assembly (5), a back cover (6) and a pair of spring tabs (7). The dielectric housing defines a plurality of ribs (118). The first sub-assembly defines a row of front partitions (312) cooperating with the ribs of the dielectric housing and a row of back partitions (314) respectively positioning in opposite sides thereof. The second sub-assembly defines a row of front partitions (412) cooperating with the back partitions of the second sub-assembly and a row of back partitions (414) respectively positioning in opposite sides thereof. The third sub-assembly (5) defines a row of front partitions (512) cooperating with the back partitions of the second sub-assembly and a row of back partitions (514). The back cover defines a plurality of partitions (63) cooperating with the back partitions of the third sub-assembly.

10 Claims, 6 Drawing Sheets

PLUGGABLE CONNECTOR WITH A HIGH DENSITY STRUCTURE

BACKGROUND OF THE INVENTION

1. Field of the Invention

This invention generally relates to a pluggable connector, and more particularly to a small form pluggable connector used in fiber or copper devices for high speed fiber optical communication.

2. Description of the Prior Art

Various international and industry standards are provided to define electrical connectors and transceivers that are used to interface communication equipment and devices for networking applications. One of the standards is known as a small form-factor pluggable (SFP) transceiver receptacle. The conventional transceiver receptacle includes a pluggable connector and a metal cage for shielding against electromagnetic interference (EMI). The cage, which is significantly larger than the pluggable connector, is dimensioned to receive and guide a transceiver module into mating connection with the pluggable connector. However, each transceiver module is a discrete unit, and it is desired to integrate a plurality of transceiver modules on a printed circuit board, therefore there is a need to provide a plurality of pluggable connectors to mate with the transceiver modules.

U.S. Pat. No. 6,558,191 issued on May 6, 2003 discloses a stacked transceiver receptacle assembly having an intermediate printed circuit board. A plurality of first and second transceiver receptacles are mounted on respective opposite sides of the printed circuit board. Each of the first and second transceiver receptacles includes a pluggable connector disposed in a cage shielding. The pluggable connector is electrically connected to the intermediate printed circuit board and is configured for electrically mating with a respective transceiver, module. The cage is configured to receive and guide the respective transceiver module into mating with the pluggable connector. Due to multiple transceiver modules on the intermediate printed circuit board, the number of the pluggable connectors and the corresponding cages inevitably increases. Therefore, the conventional stacked transceiver receptacle still can not effectively minimize the required space. Furthermore, the cost of the product and assembly correspondingly increases.

Hence, an improved pluggable connector is desired to overcome the above problems.

SUMMARY OF THE INVENTION

It is an object of the present invention to effectively reduce the required space of multiple transceiver receptacles in electronic equipment.

It is another object of the present invention to effectively reduce the cost of multiple transceiver receptacles.

In order to attain the objective above, a pluggable connector includes a dielectric housing, a contact group, a first sub-assembly, a second sub-assembly, a third sub-assembly, a back cover and a pair of spring tabs. The dielectric housing defines a plurality of ribs. The first sub-assembly defines a row of front partitions cooperating with the ribs of the dielectric housing and a row of back partitions respectively positioning in opposite sides thereof. The second sub-assembly defines a row of front partitions cooperating with the back partitions of the second sub-assembly and a row of back partitions respectively positioning in opposite sides thereof. The third sub-assembly defines a row of front partitions cooperating with the back partitions of the second sub-assembly and a row of back partitions. The back cover defines a plurality of partitions cooperating with the back partitions of the third sub-assembly.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which corresponding reference numerals identify like elements in the figures and in which:

DETAILED DESCRIPTION OF THE PREFERRED EMBODIMENT

Reference will now be made in detail to the preferred embodiment of the present invention.

Figure 1:
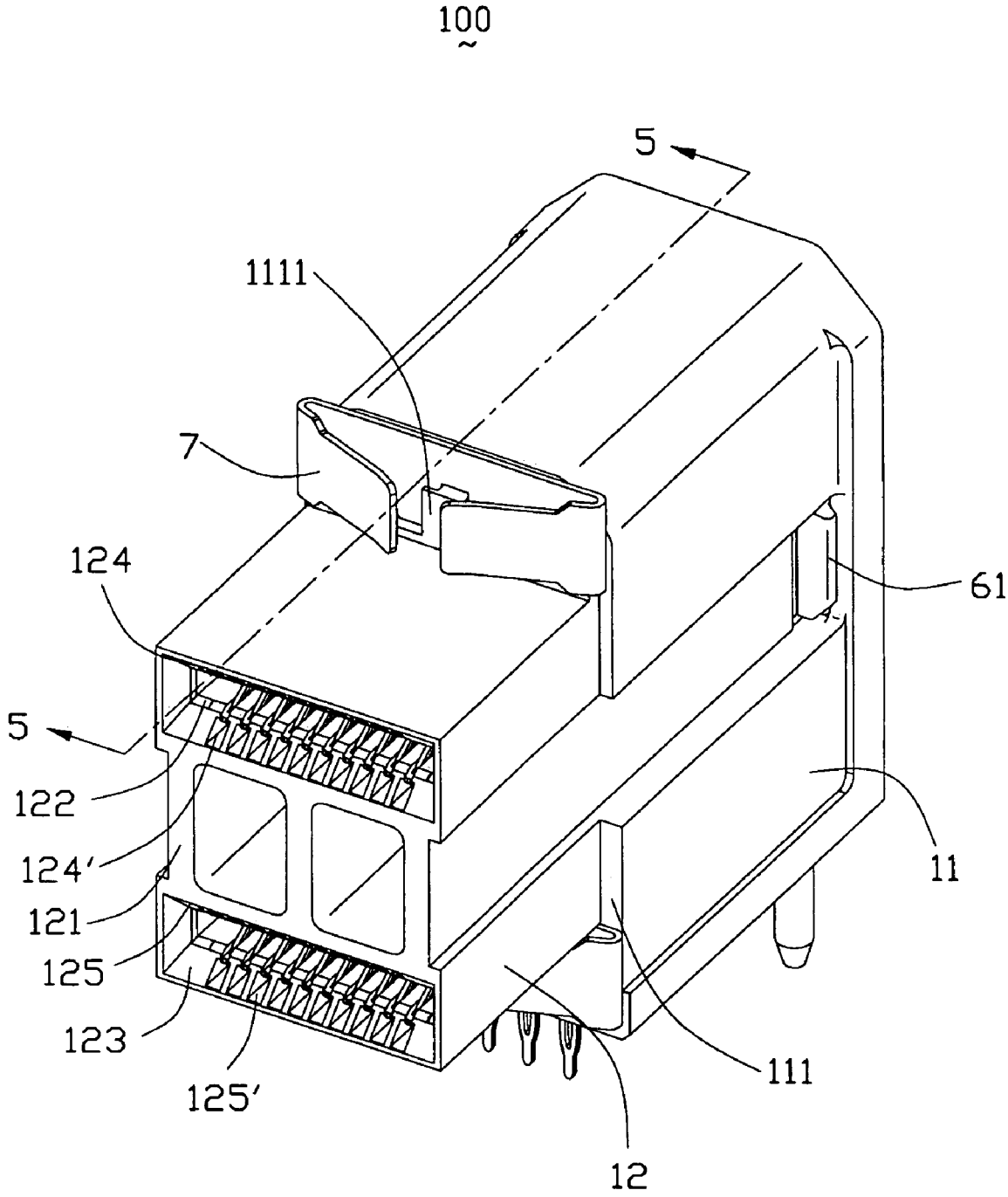
FIG. 1 is a perspective view of a pluggable connector according to the present invention.
Figure 2:
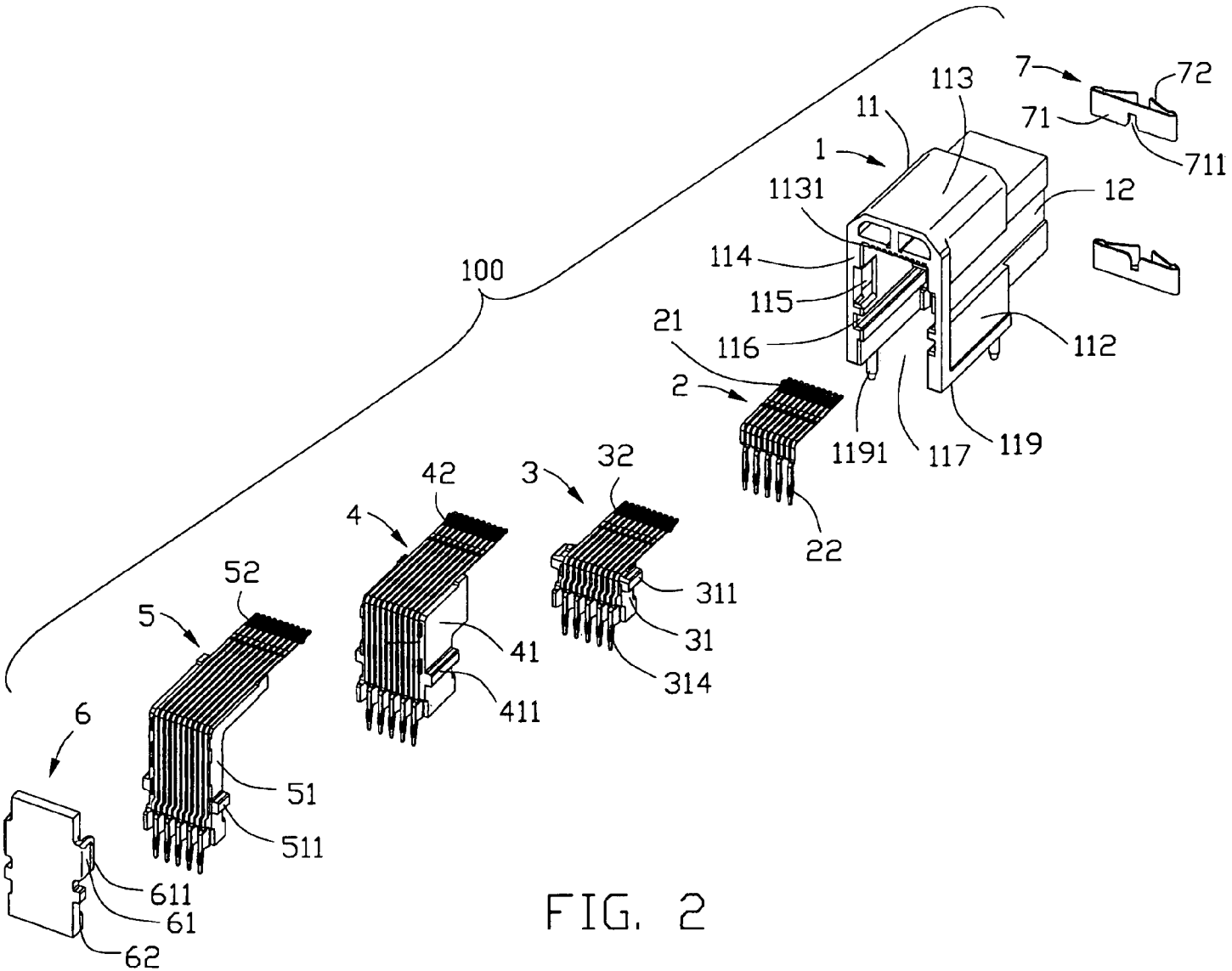
FIG. 2 is an exploded view of the pluggable connector from a rear perspective.

Referring to FIGS. 1–2, a pluggable connector 100 according to the present invention includes a dielectric housing 1, a contact group 2, a first sub-assembly 3, a second sub-assembly 4, a third sub-assembly 5, a back cover 6 and a pair of spring tabs 7.

Figure 3:
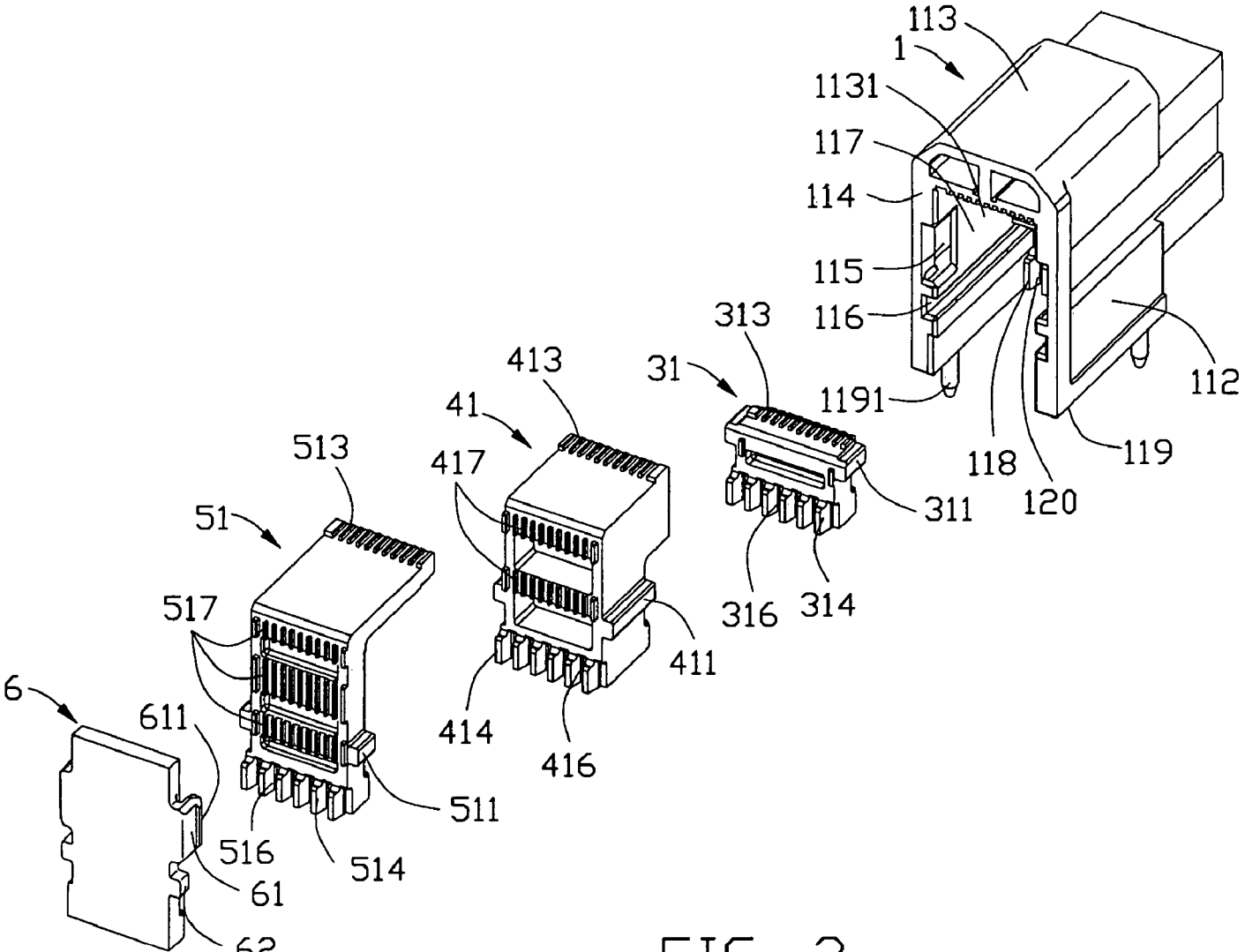
FIG. 3 is a partially exploded view of the pluggable connector from a rear perspective, depicting the dielectric components only.
Figure 4:
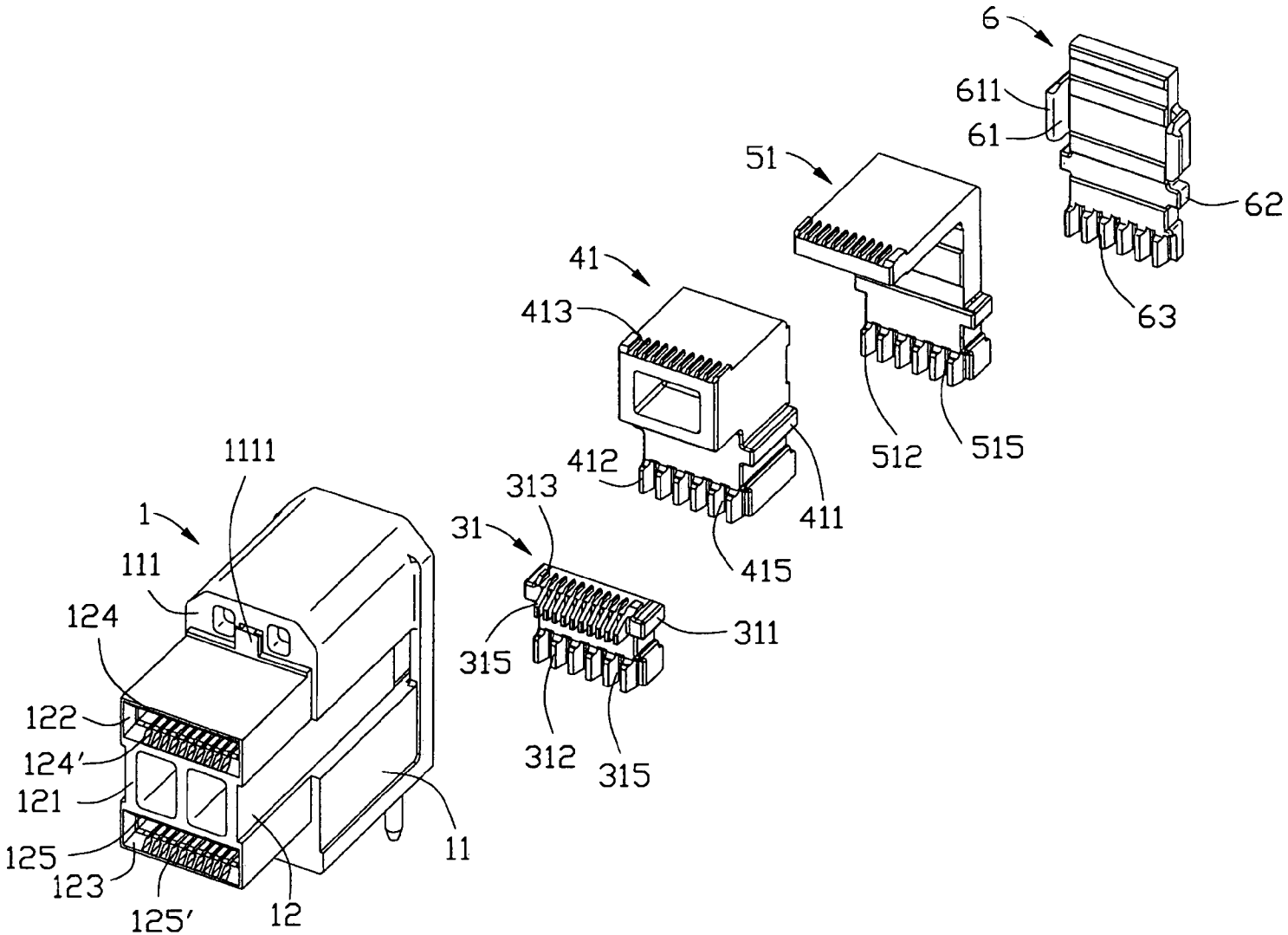
FIG. 4 is another partially exploded view of the pluggable connector from a front perspective, depicting the dielectric components only.
Figure 5:
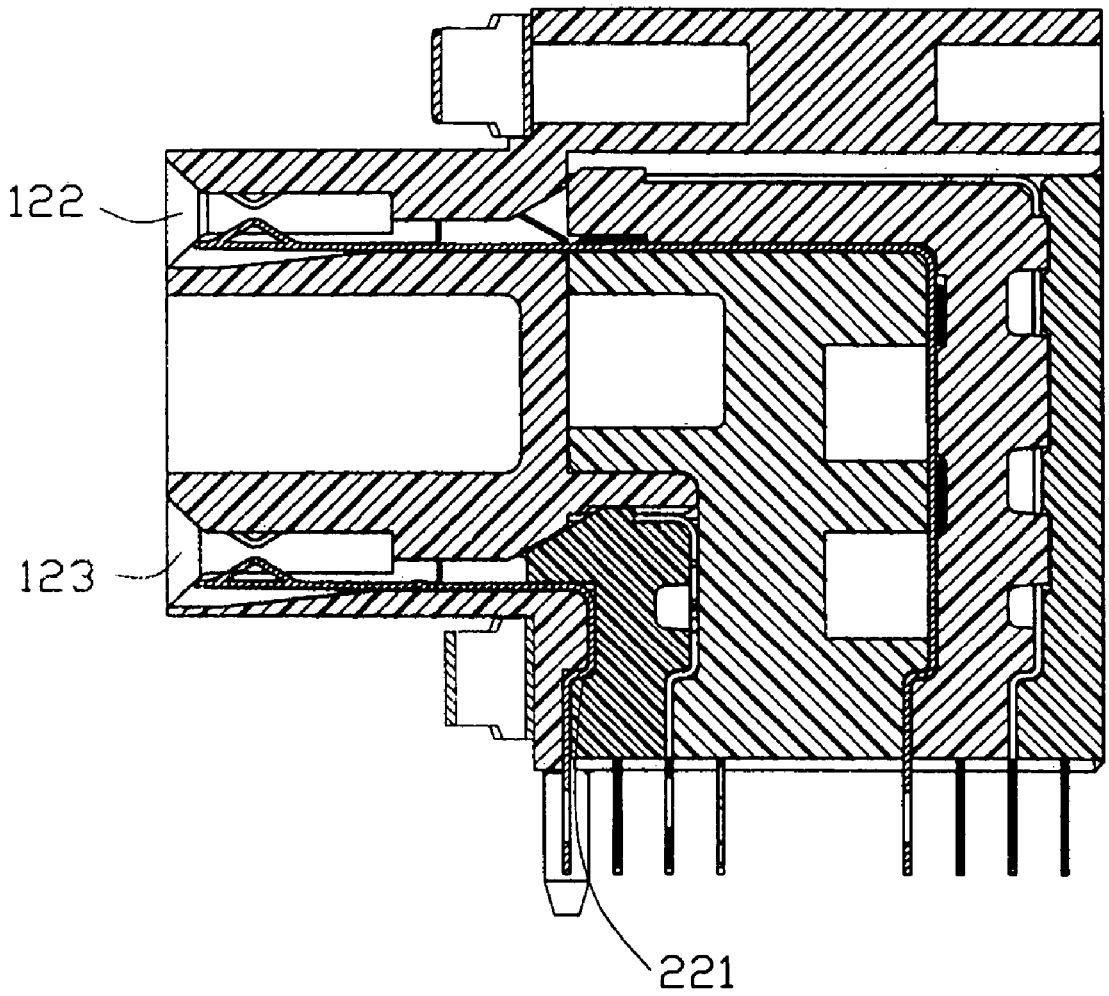
FIG. 5 is a cross sectional view of the pluggable connector taken through section line 5—5 of FIG. 1.

Referring to FIGS. 3–4 in conjunction with FIG. 5, the dielectric housing 1 includes a main body 11 and a mating portion 12 forwardly projecting from the main body 11. The main body 11 includes a front face 111, a pair of side faces 112, a top face 113, a bottom face 119 and a rear face 114. The main body 11 further defines a cavity 117 extending through the rear face 114 and the bottom face 119. The main body 11 is formed with an upper and a lower protrusions 1111 on the front face 111 and respectively adjacent to the top and bottom faces 113, 119 for retaining the spring tabs 7. Each side face 112 defines a cutout 115 adjacent to the rear face 114 and communicating with the cavity 117. A pair of grooves 116 are respectively defined in an inner surface of the side face 112 and extending through the rear face 114. A plurality of slots 1131 are defined on inner face of the top face 113. The main body 11 further forms a row of partitions 118 adjacent to the bottom face 119. Dual positioning posts 1191 downwardly extend from the bottom face 119 for being inserted into corresponding holes (not shown) of a printed circuit board (not shown) to which the pluggable connector 100 is mounted.

The mating portion 12 includes a mating face 121 defining an upper and a lower port 122, 123 communicating with the cavity 117 for respectively receiving a transceiver module (not shown). The upper port 122 defines upper and lower channels 124, 124' for respectively receiving corresponding contacts. The lower port 123 also defines upper and lower channels 125, 125' for respectively receiving corresponding contacts.

Figure 6:
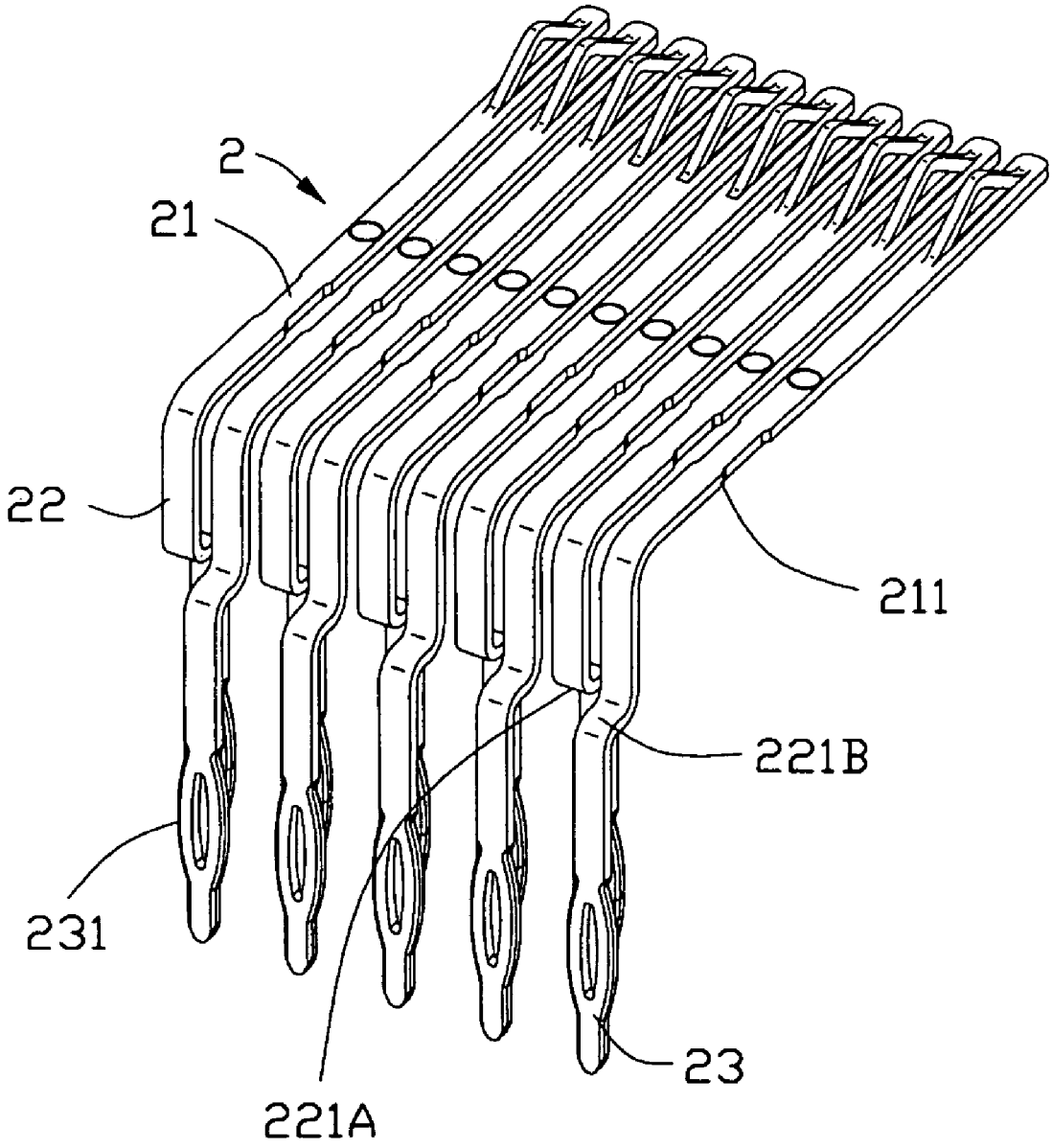
FIG. 6 is an isometric view of a contact group of the pluggable connector.

As shown in FIG. 6, the contact group 2 includes a plurality of substantially "L" shaped contacts and each contact is stamped from a metal sheet. Each contact includes a horizontal portion 21 being received in the lower channels 125' of the dielectric housing 1, a vertical portion 22 downwardly extending from the horizontal portion 21 and being received in the ribs 118 of the dielectric housing 1 and a tail portion 23 for being inserted into the corresponding holes of the printed circuit board. The horizontal portion 21 comprises a pair of barbs 211 in opposite sides thereof for securely engaging with the channels 125' of the lower port 123 of the dielectric housing 1. The vertical portion 22 forms a bent portion forming a differential form 221A, 221B abutting against a projection (not labeled) of the main body 11 of the dielectric housing 1 for preventing the contact from upwardly moving during the tail portion 23 being inserted into the printed circuit board. Thus, the contact group 2 can be securely retained in the main body 11 of the dielectric housing 1. Furthermore, the vertical portion 22 forms a pair of downwardly oriented interface projections 231 for securely being inserted into corresponding holes (not shown) of a mother printed circuit board (not shown).

Referring to FIGS. 2–4, the first sub-assembly 3 includes a substantially vertical body portion 31 and a row of first contacts 32 retained in the body portion 31. The body portion 31 is formed with plural front and back partitions 312, 314 on opposite sides thereof and adjacent to a bottom portion thereof, thereby forming a plurality of slots 315, 316 between adjacent front and back partitions 312, 314. The vertical jogged portions of the first contacts 32 are received in the slots 316 of the body portion 31. The first contacts 32 are substantially identical to the contact group 2 in structure except the length of horizontal portion. Therefore, the further details will not be repeated. The front partitions 312 are offset from the back partitions 314 by a half pitch of adjacent two partitions. A pair of guide ribs/keys 311 are formed on opposite edges of the body portion 31 for guiding the first sub-assembly 3 through the grooves 116 into the cavity 117 of the dielectric housing 1. A number of slots 313 are defined on a top surface of the body portion 31 for anchoring the first contacts 32. A plurality of slanted ribs 315 are formed at a forward end of the body portion 31 for preferably guiding the first contacts 32 into the upper row of the lower port 123 of the dielectric housing 1.

The second sub-assembly 4 includes a second main body 41 and a row of second contacts 42. The second main body 41 also defines front and back partitions 412, 414, a plurality of slots 415, 416 defined by adjacent front and back partitions 412, 414, a plurality of upper slots 413 and a pair of guiding ribs/keys 411, which are identical to that of the first sub-assembly 3 in structure. The second contacts 42 also are identical to the second contacts 32 in structure. Furthermore, vertical jogged portions of the second contacts 42 are received in the corresponding slots 416 defined by the back partitions 414 of the second main body 4. Due to the second main body 41 of the second sub-assembly 4 is taller than the body portion 31 of the first sub-assembly 3, the body portion 41 further defines two rows of guide slots 417 spaced apart from each other for receiving the second contacts 42 and preferably preventing the vertical portions of the second contacts 42 from bowing toward each other.

The third sub-assembly 5 includes a substantially inverted "L" shaped body 51 and a row of third contacts 52 disposed in the body 51. The body 51 defines a pair of guiding ribs/keys 511, the front and back partitions 512, 514, the slots 515, 516 defined by adjacent front and back partitions 512, 514, the upper slots 513 and the guide slots 517, which are still substantially identical to that of the main body 41 of the second sub-assembly 4. In addition, the third contacts 52 still are identical to the first and second contacts 32, 42 except the length of the horizontal portions and vertical portions. Vertical jogged portions of the third contacts 52 are received in the slots 516 of the body 51, which are still identical to the second contacts 42. Therefore, further details will not be repeated.

It is noted that although the first contacts 32, the second contacts 42 and the third contacts 52 have different lengths for preferably extending into the upper and lower ports 122, 123 of the dielectric housing 1. The vertical portions of the tails of the above contacts 32, 42, 52 are equal beyond the bottom face 119 of the dielectric housing 1, as is shown in FIG. 5.

The back cover 6 is substantially a plate and includes a pair of flanges 61 forwardly extending from opposite edges thereof for engaging with the cutouts 115 of the dielectric housing 1. Each flange 61 defines a protrusion 611 beyond the corresponding cutout 115 when the flanges 61 fully engage with the cutouts 115. The back cover 6 also includes a pair of guiding ribs/keys 62 for guiding the back cover 6 through the grooves 116 into the dielectric housing 1. A plurality of partitions 63 are defined in a bottom portion thereof, which are identical to that of the above sub-assemblies 3, 4, 5.

The spring tab 7 is formed by stamping from a metal sheet and includes a horizontal portion 71 and a pair of spring arms 72 extending toward each other from opposite edges of the horizontal portion 71. A notch 711 is defined at a substantially middle portion of a bottom edge of the horizontal portion 71. The notch 711 engages with the protrusion 1111 of the dielectric housing 1, thereby securely assembling the spring tab 7 on the dielectric housing 1. When the transceiver module mates with the pluggable connector 100, the spring tab 7 will elastically deflect. When the transceiver is unmated with the pluggable connector 100, the spring tab 7 will provide sufficient spring force to eject the transceiver module.

Referring to FIGS. 1–6, in assembly, firstly, the contact group 2 are inserted into the cavity 117 from the rear face 114 of the dielectric housing 1, with the horizontal portions 21 being received in the lower channels 125' of the lower port 123 of the dielectric housing 1 and the vertical portions being received in the ribs 118 of the dielectric housing 1. Secondly, the first sub-assembly 3 is guided into the cavity 117 of the dielectric housing 1 via the ribs/keys 311 received in the grooves 116 of the dielectric housing 1. The front partitions 312 of the first sub-assembly 3 cooperate with the ribs 118 of the dielectric housing 1 to securely fix the vertical portions of the contact group 2. At the same time, the first contacts 32 of the first sub-assembly 3 are inserted into the upper channels 125 of the lower port 123 of the dielectric housing 1. Thirdly, the second sub-assembly 4 is guided into the cavity 117 of the dielectric housing 1 via the ribs/keys 411 received in the grooves 116. The front partitions 412 of the second sub-assembly 4 are received in the slots 316 defined between the back partitions 314 of the first sub-assembly 3 to securely fix the first contacts 32. Horizontal portions of the second contacts 42 are received in the lower channels 124' of the upper port 122 of the dielectric housing 1. Fourthly, the third sub-assembly 5 is guided into the cavity 117 of the dielectric housing 1 via the ribs/keys 511 received in the grooves 116, which are identical to the second sub-assembly 4 being guided in the cavity 117. The front partitions 512 cooperate with the back partitions 414 of the second sub-assembly 4 to thereby securely fix the second contacts 42. The third contacts 52 are received in the upper channels 124 of the upper port 122 of the dielectric housing 1. Finally, the back cover 6 is pressed into the cavity 117 via the ribs/keys 62 received in the grooves 116, with the projections 61 being inserted into the cutouts 115 of the dielectric housing 1 and the front partitions 63 cooperating with the back partitions 514 of the third sub-assembly 5 to fix the third contacts 52. Then, the spring tabs 7 are assembled on the main body 11 of the dielectric housing 1, with the notches 711 of the spring tabs 7 engaging with the corresponding protrusions 1111 of the dielectric housing 1.

There is a need to note that the grooves 116 defined in the dielectric housing 1 also can be defined in the first, second, third sub-assembly 3, 4, 5 and the back cover 6. The guide ribs/keys 311, 411, 511, 62 of the first, second, third sub-assembly 3, 4, 5 and the back cover 6 also can be formed in the dielectric housing 1.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

a dielectric housing comprising a mating portion defining a plurality of channels, a cavity, a plurality of ribs in the cavity and a plurality of slots between adjacent ribs;

a contact group having a plurality of contacts received in the slots of the dielectric housing and extending into corresponding channels of the dietetic housing;

a first sub-assembly having a main body and a plurality of first contacts disposed on the main body, each contact comprising a mating portion extending into a corresponding channel of the mating portion, the main body defining a plurality of partitions, each partition being received in a corresponding slot of the dielectric housing to retain a corresponding contact of the contact group in the corresponding slot;

a groove defined in either the dielectric housing or the first sub-assembly and a guide rib/key disposed in the other of the sub-assembly and the dielectric housing engaging with the groove; and a pair of spring tabs each defining a notch in a substantially middle portion thereof wherein the dielectric housing defines a pair of protrusions for engaging with corresponding notches of the spring tabs.

2. The electrical connector according to claim 1, wherein the main body of to first sub-assembly defines a plurality of retaining slots for anchoring the first contacts.

3. The electrical connector according to claim 1, wherein each first contact defines a born portion, and wherein the dielectric housing defining a projection abutting against the bent portion of the first contact for preventing the first contact from upwardly moving.

4. The electrical connector according to claim 1, further comprising a second sub-assembly having a body portion and a plurality of second contacts disposed in to body portion and extending into corresponding channels of the dielectric housing.

5. The electrical connector according to claim 4, wherein the main body of the second sub-assembly defines a plurality of first and second partitions, and wherein the first sub-assembly forms a plurality of fourth partitions and defines a plurality of fourth slots between every two adjacent fourth partitions, at least a first set of the first contacts being respective retained in corresponding fourth slots, the first partitions of the second subassembly cooperating with corresponding fourth slots of the first sub-assembly to retain said first set of the first contacts.

6. The electrical connector according to claim 5, wherein every two adjacent first partitions of the second sub-assembly define a first slot therebetween, and wherein the first sub-assembly forms a plurality of fourth partitions, each of a second set of the first contacts at least partially extending on a corresponding fourth partition, the fourth partitions of the first sub-assembly being received in corresponding first slot of the second sub-assembly for securing the second set of the first contacts.

7. The electrical connector according to claim 5, further comprising a tint sub-assembly having a body and a plurality of third contacts disposed in the body and extending into corresponding channels of the dielectric housing.

8. The electrical connector according to claim 7, wherein the body defines a plurality of third partitions for cooperating with the second partitions of the second sub-assembly to retain the second contacts.

9. The electrical connecter according to claim 8, further comprising a back cover defining a of projections extending from opposite sides thereof, and wherein the dielectric housing defines a pair of cutouts for receiving the projections of the beck cover.

10. The electrical connector according to claim 9, wherein the back cover defines a plurality of partitions for cooperating with the third partitions of the third sub-assembly to retain the third contacts of the third sub-assembly.

* * * * *